US008763599B2

(12) United States Patent
Karau et al.

(10) Patent No.: US 8,763,599 B2
(45) Date of Patent: Jul. 1, 2014

(54) MASONRY BLOCK MULTI-SPLITTING APPARATUS AND METHOD

(75) Inventors: William Howard Karau, Southlake, TX (US); Joerg Marx, Grapevine, TX (US)

(73) Assignee: Pavestone, LLC, Atlanta, GA (US)

( * ) Notice: Subject to any disclaimer, the term of this patent is extended or adjusted under 35 U.S.C. 154(b) by 2007 days.

(21) Appl. No.: 11/583,192

(22) Filed: Oct. 18, 2006

(65) Prior Publication Data

US 2008/0092869 A1 Apr. 24, 2008

(51) Int. Cl.
*B28D 1/26* (2006.01)

(52) U.S. Cl.
USPC ..... 125/23.01; 125/40

(58) Field of Classification Search
USPC ..... 125/23.01, 23.02, 40, 41; 144/193.1, 144/195.1, 195.8
See application file for complete search history.

(56) References Cited

U.S. PATENT DOCUMENTS

| | | | | |
|---|---|---|---|---|
| 1,534,353 | A | 4/1925 | Besser | |
| 1,872,522 | A | 8/1932 | Stuckey | |
| 4,335,549 | A | 6/1982 | Dean, Jr. | |
| 4,391,312 | A * | 7/1983 | Sakraida, Jr. | 144/195.8 |
| 4,627,764 | A | 12/1986 | Scheiwiller | |
| 4,782,866 | A * | 11/1988 | Valdez | 144/195.8 |
| 4,830,071 | A * | 5/1989 | Gollahon | 144/195.1 |
| 4,973,192 | A | 11/1990 | Hair | |
| D315,026 | S | 2/1991 | Castonguay et al. | |
| 5,487,526 | A | 1/1996 | Hupp | |
| D377,181 | S | 1/1997 | Hupp | |
| D378,702 | S | 4/1997 | Blomquist et al. | |
| 5,733,470 | A | 3/1998 | Roth et al. | |
| 5,884,445 | A | 3/1999 | Woolford | |
| 6,029,943 | A | 2/2000 | Sievert | |
| 6,050,255 | A * | 4/2000 | Sievert | 125/23.01 |
| 6,142,713 | A | 11/2000 | Woolford et al. | |
| D442,703 | S | 5/2001 | Fifield | |
| D448,861 | S | 10/2001 | Daniels et al. | |
| 6,668,816 | B1 | 12/2003 | Pedersen et al. | |
| D505,733 | S | 5/2005 | Castonguay et al. | |
| 6,918,715 | B2 | 7/2005 | Scherer et al. | |
| 7,055,517 | B1 | 6/2006 | Kitahara | |

(Continued)

FOREIGN PATENT DOCUMENTS

| | | |
|---|---|---|
| GB | 948121 | 1/1964 |

OTHER PUBLICATIONS

"Haith Robot System for Aggregate Industries," http://www.hub-4.com/news/109/haith-robot-system-for-aggregate-industries, Jul. 31, 2006.

(Continued)

*Primary Examiner* — Eileen P. Morgan
(74) *Attorney, Agent, or Firm* — Jackson Walker L.L.P.; Christopher J. Rourk

(57) ABSTRACT

An apparatus for splitting a plurality of masonry blocks is provided. The apparatus includes a plurality of first splitting blades that are configured to simultaneously move in a first direction, so as to split one of each of the plurality of masonry blocks into two or more sections during a single splitting operation. Each section has a first split surface. A plurality of second splitting blades is provided, where each is perpendicular and adjacent to one of the first splitting blades. Each of the second splitting blades is configured to form a second split surface on one of the masonry block sections that is perpendicular to at least one of the first split surfaces.

17 Claims, 6 Drawing Sheets

(56) References Cited

U.S. PATENT DOCUMENTS

| | | | | |
|---|---|---|---|---|
| 5,827,015 | A1 | 8/2006 | Woolford et al. | |
| 7,104,295 | B2 * | 9/2006 | Heikkinen et al. | 144/193.1 |
| 6,142,713 | C1 | 11/2006 | Woolford et al. | |
| 7,243,646 | B2 * | 7/2007 | Todack | 125/23.01 |
| 2005/0194000 | A1 * | 9/2005 | Todack | 125/23.01 |
| 2006/0054154 | A1 | 3/2006 | Scherer | |
| 2008/0096471 | A1 * | 4/2008 | Karau et al. | 451/41 |

OTHER PUBLICATIONS

"Reconstructed Stone—Stone Pitchers," http://www.haithindustrial.co.uk/index.php ?sec=cont&id=26, Jul. 31, 2006.

"Natural Stone—Block and Slab Splitting," http://www.haithindustrial.co.uk/index.php?sec=cont&id=32 Jul. 31, 2006.

"Splitting, Cutting, Marking & Layout," http://www.pavetech.com/newtools/cutting.shtm, Jul. 31, 2006.

"Stone Splitter," http://www.pavetech.com/newtools/stonesplitter.shtm, Jul. 31, 2006.

"Splitters/Turnovers," http://www.besser.com/equipment/splitters/, Aug. 3, 2006.

"Split-Face Concrete Block," http://www.toolbase.org/Technology-Inventory/walls/split-face-concrete-block, Aug. 3, 2006.

* cited by examiner

MASONRY BLOCK MULTI-SPLITTING APPARATUS AND METHOD

RELATED APPLICATIONS

This application is related to U.S. application Ser. No. 11/583,592, entitled "CONCRETE BLOCK SPLITTING AND PITCHING APPARATUS AND METHOD," filed Oct. 18, 2006, and U.S. application Ser. No. 11/583,194, entitled "CONCRETE BLOCK SPLITTING AND PITCHING APPARATUS AND METHOD," filed Oct. 18, 2006, commonly owned, filed herewith and incorporated by reference for all purposes.

FIELD OF THE INVENTION

The present invention pertains to the field of masonry block manufacturing, and more specifically to a masonry block splitting apparatus and method for splitting multiple masonry blocks in a single process.

BACKGROUND OF THE INVENTION

Prior art systems for manufacturing concrete, masonry, or other structural blocks (hereinafter referred to in general as "masonry blocks") utilized splitter assemblies. Such splitter assemblies are typically used to form a single split in a masonry block. For example, two opposing blades may be used to split the masonry block, or two additional blades can be provided in a lateral direction so as to provide a splitting force that is uniform around the circumference of the masonry block. Where additional cuts are to be made in the masonry block, it is typically fed through the two or four splitting blades, and sections of the masonry block are split off in series.

While some multiple splitting blade assemblies have been provided in the prior art, they are typically provided with blades that are perpendicular to each other, so as to quarter a block. Likewise, such blocks are typically manufactured with different materials so as to facilitate breakage along the quarter points.

SUMMARY OF THE INVENTION

In accordance with the present invention, a masonry block splitting apparatus and method are provided that allow multiple masonry blocks to be split in a single step.

In particular, a system and method for splitting masonry blocks are provided that allow two or more masonry blocks to be split by a single compression cycle of a splitting press.

In accordance with an exemplary embodiment of the present invention, an apparatus for splitting a masonry block is provided. The apparatus includes a plurality of first splitting blades that are configured to simultaneously move in a first direction, so as to split one of each of the plurality of masonry blocks into two or more sections during a single splitting operation. Each section has a first split surface. A plurality of second splitting blades is provided, where each is perpendicular and adjacent to one of the first splitting blades. Each of the second splitting blades is configured to form a second split surface on one of the masonry block sections that is perpendicular to at least one of the first split surfaces.

The present invention provides many important technical advantages. One important technical advantage of the present invention is an apparatus for forming a plurality of split masonry blocks using two or more adjacent splitting blades that operate on the masonry blocks during a single compression cycle of a splitting press.

Those skilled in the art will further appreciate the advantages and superior features of the invention together with other important aspects thereof on reading the detailed description that follows in conjunction with the drawings.

DETAILED DESCRIPTION OF PREFERRED EMBODIMENTS

Figure 1:
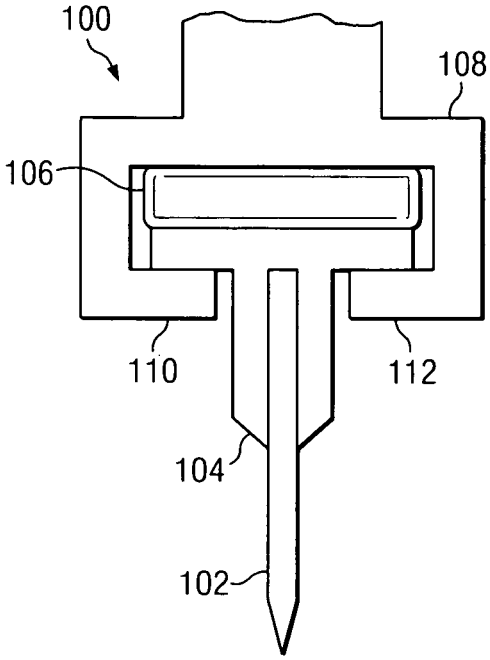
FIG. 1 is a diagram of a splitting blade assembly in accordance with an exemplary embodiment of the present invention.

In the description that follows, like parts are marked throughout the specification and drawings with the same reference numerals. The drawing figures might not be to scale and certain components can be shown in generalized or schematic form and identified by commercial designations in the interest of clarity and conciseness.

FIG. 1 is a diagram of splitting blade assembly 100 in accordance with an exemplary embodiment of the present invention. Splitting blade assembly 100 allows blade movement in two axes relative to the masonry block being split so as to align the splitting blade with the surface of the masonry block and avoid splitting outside of the plane of the splitting blade.

Splitting blade assembly 100 includes splitting blade 102 and blade holder 104. Blade holder 104 is held in press 108 by lips 110 and 112. In one exemplary embodiment, one or more of lips 110 or 112 can be affixed to press 108 with a swivel, pins, or in other suitable manners so that they can be moved to facilitate easier removal and replacement of splitting blade 102 and blade holder 104.

Compressible material 106 is disposed between press 108 and blade holder 104. In one exemplary embodiment, compressible material 106 is made from hard rubber or other suitable materials, and allows blade holder 104 to move relative to press 108 as splitting blade 102 comes into contact with a masonry block. Surface irregularities of the masonry block can cause splitting blade 102 to slip or catch on the surface of the masonry block prior to the initiation of the splitting operation, or where the surface of the masonry block is not entirely perpendicular, splitting can be initiated on only part of the masonry block, such that the split does not propagate in a two-dimensional plane through the masonry block but instead forms a three dimensional split surface. Compressible material 106 allows splitting blade 102 to conform to the surface of the masonry block so as to avoid damage to the masonry block, non-planar split progression, or other undesired effects.

In operation, compressible material 106 allows blade holder 104 to move relative to the surface of a masonry block as press 108 is moved downwards. In this manner, splitting blade 102 will align with or conform to the surface of the masonry block being split, so as to prevent initiation of a split at a nonconformity of a masonry block that is higher than the average surface. By allowing splitting blade 102 to move relative to the surface, the split initiated in a masonry block is more likely to follow the plane of splitting blade 102 and not deviate from that plane.

Figure 2:
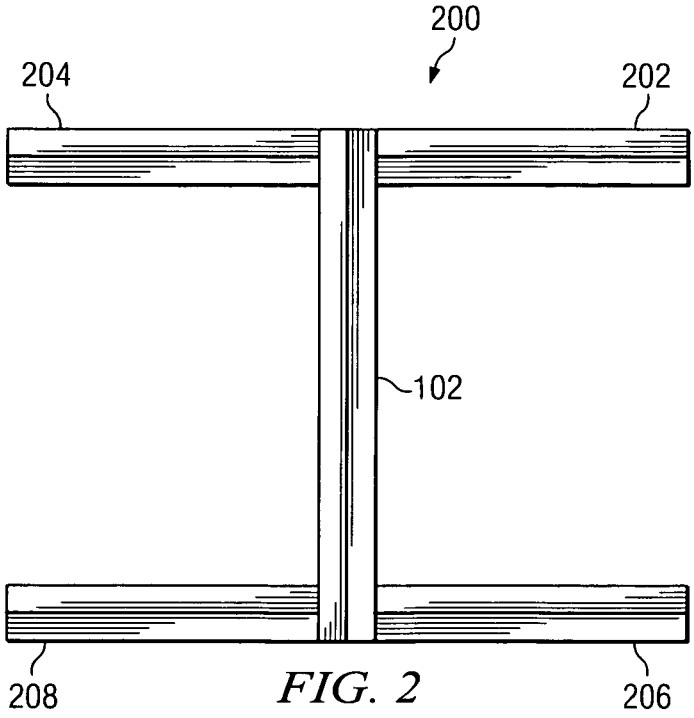
FIG. 2 is a diagram of a multiple plane splitting blade in accordance with an exemplary embodiment of the present invention.

FIG. 2 is a diagram of multiple plane splitting blade 200 in accordance with an exemplary embodiment of the present invention. Multiple plane splitting blade 200 includes a primary splitting blade 102 and perpendicular splitting blades 202, 204, 206, and 208, each of which can be fabricated from carbon steel, silicon steel, silicon carbide, or other suitable materials for use in blades for splitting masonry blocks. In one exemplary embodiment, the cutting edge of splitting blade 102 extends beyond the cutting edge of perpendicular splitting blades 202, 204, 206, and 208, such that the first split of a masonry block is made by splitting blade 102 and subsequent splits of the masonry block are made by perpendicular splitting blades 202, 204, 206, and 208. Splitting blade 102 can be fitted into a slot formed in a single blade that creates perpendicular splitting blades 202 and 204 and perpendicular splitting blades 206 and 208, each of perpendicular splitting blades 202, 204, 206, and 208 can be separate blades that are held in position by a blade holder, can be welded or otherwise affixed to splitting blade 102, or other suitable configurations can be used.

In operation, multiple plane splitting blade 200 is used to perform splits in two or more directions on a single masonry block, so as to eliminate the need to move the masonry block sections after splitting, this saving time and reducing the number of steps required to manufacture such multi-faced blocks. Multiple plane splitting blade 200 can be used as described below to create blocks having multiple split faces, to provide distinctive features to a split block, or for other suitable purposes.

Figure 3:
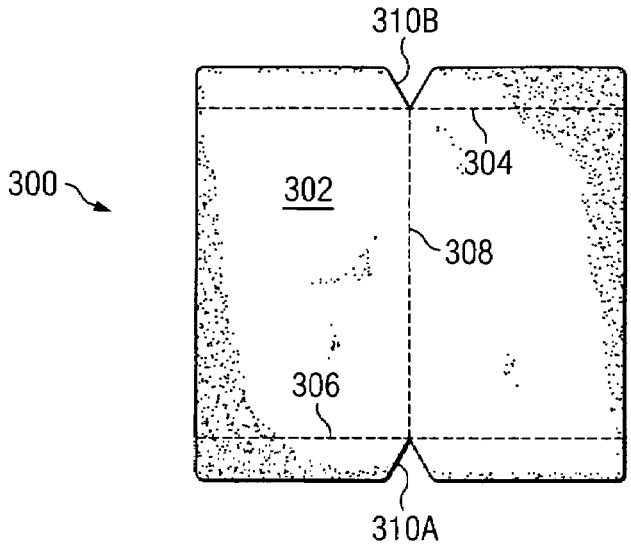
FIG. 3 is a diagram of a masonry block in accordance with an exemplary embodiment of the present invention.

FIG. 3 is a diagram of masonry block 300 in accordance with an exemplary embodiment of the present invention. Masonry block 300 can be used in conjunction with multiple plane splitting blade 200 of FIG. 2 to form a block having three split sides, such as for use in retaining walls, pavers, or other suitable applications. Masonry block 302 includes notches 310A and 310B, which form a point for a first split line 308. Likewise, additional split lines 304 and 306 also show where a splitting blade such as multiple plane splitting blade 200 can be used to split masonry block 302 into two masonry blocks having three split surfaces, in a single splitting operation.

Figure 4:
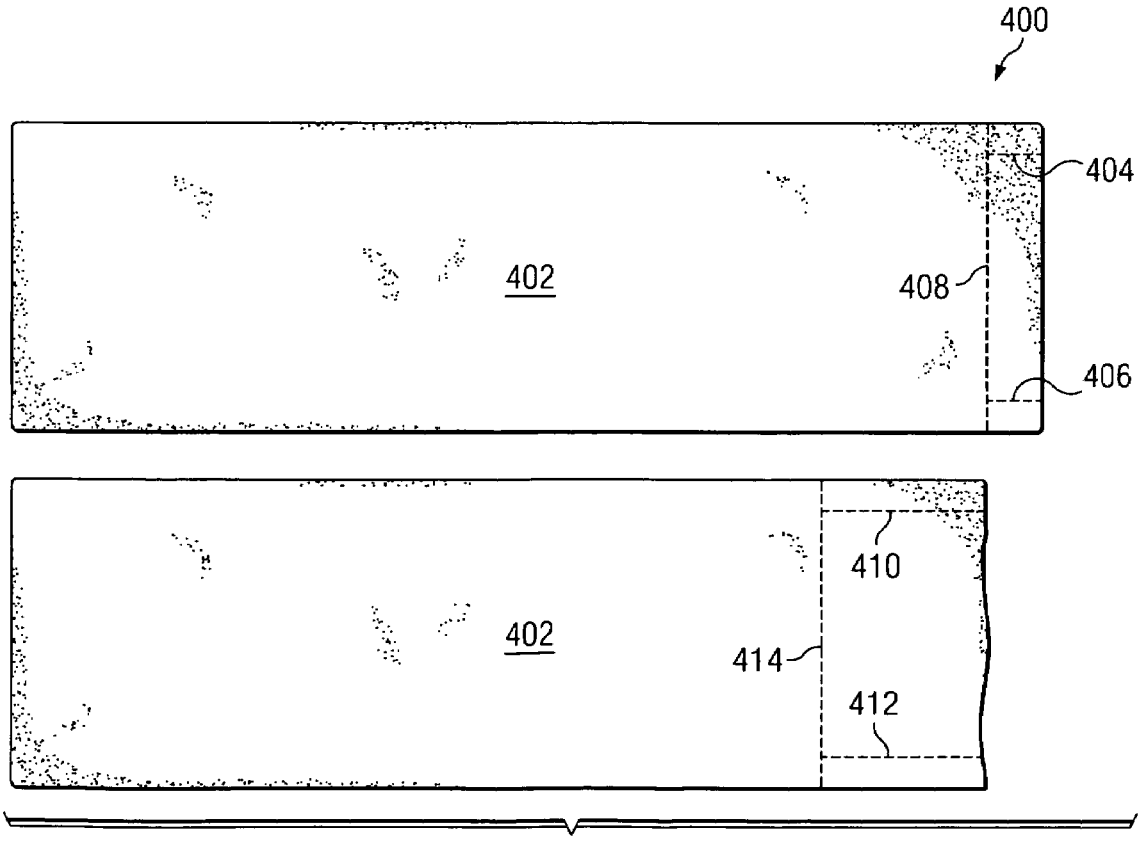
FIG. 4 is a diagram of a process for forming four-sided split surfaced blocks in accordance with an exemplary embodiment of the present invention.

FIG. 4 is a diagram of process 400 for forming four-sided split surfaced blocks in accordance with an exemplary embodiment of the present invention. Process 400 uses masonry block 402, which is split multiple times to form a plurality of masonry blocks having four split surfaces, where each successive splitting operation forms four split surfaces. In the first splitting operation, the molded end of masonry block 402 is split along split line 408, such as by using a modified configuration of multiple plane splitting blade 200 lacking perpendicular splitting blades 204 and 208. In addition, split lines 404 and 406 are formed in the small section at the end of masonry block 402, which can be used for other purposes or discarded. The splitting blade assembly is then moved sideways towards masonry block 402, or masonry block 402 is moved sideways towards the splitting blade assembly, to form split lines 414, 410, and 412, such that a block with four split faces is formed. The movement of masonry block 402 or the splitting blade assembly is then repeated, diminishing the dimensions of masonry block 402 with each splitting operation by creating a new masonry block having four split-faces.

Figure 5:
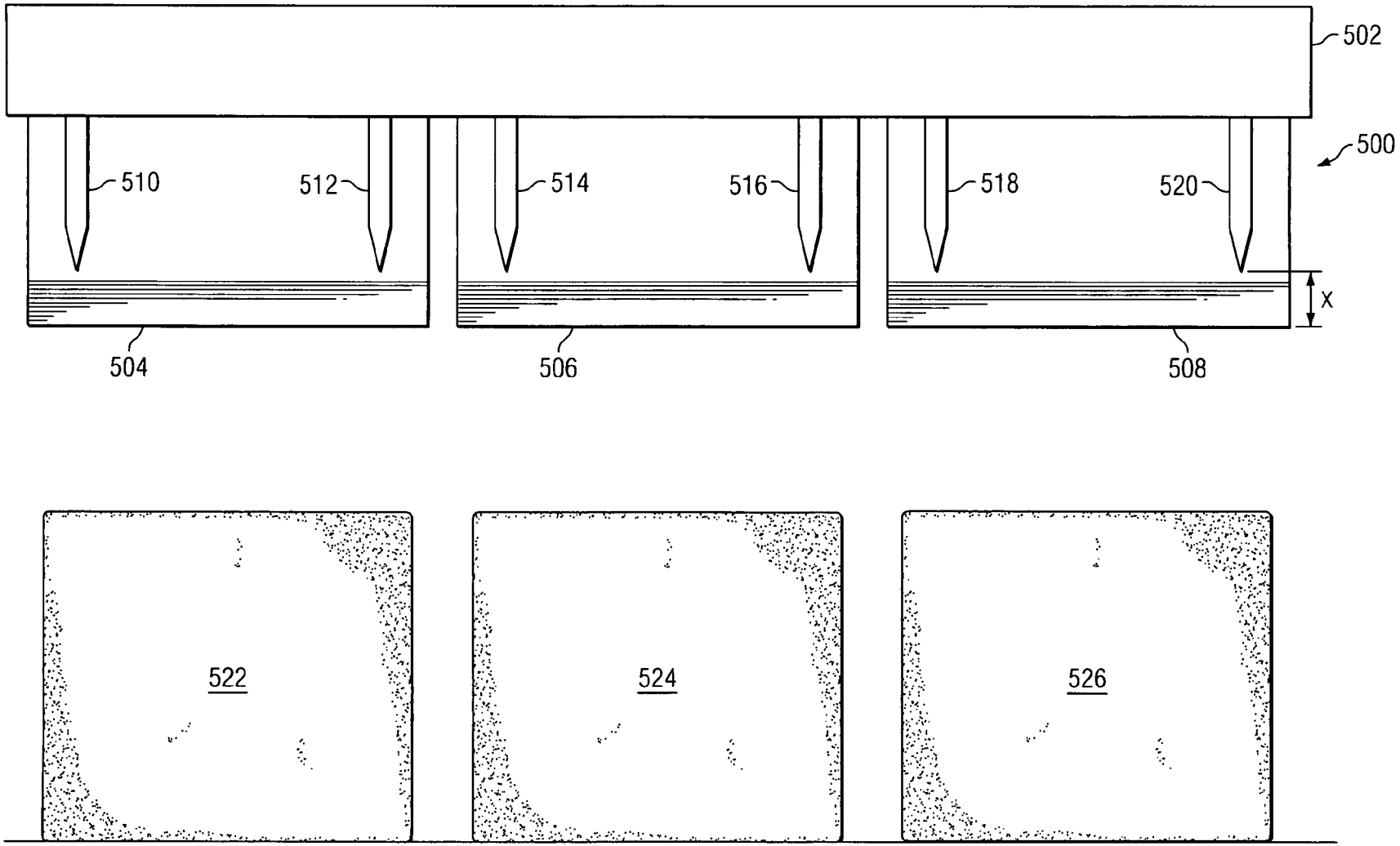
FIG. 5 is a diagram of a splitting blade assembly in accordance with an exemplary embodiment of the present invention.

FIG. 5 is a diagram of splitting blade assembly 500 in accordance with an exemplary embodiment of the present invention. Splitting blade assembly 500 includes blade holder 502 and splitting blades 504, 506, and 508. The three splitting blades 504, 506, and 508 are independent of and separated from each other, and can be used in conjunction with a compressible material 106 so as to allow each blade to conform to irregularities on the surface of the masonry block being split. Three separate blocks 522, 524, and 526, can each be split by splitting blade assembly 500 during a single compression cycle.

Splitting blades 510 and 512 are associated with splitting blade 504 and form a splitting blade assembly similar to that shown in FIG. 2. Likewise, the blade edge of splitting blades 510 through 520 are inset from the blade edge of the associated perpendicular splitting blades 504 through 508 by a distance "X." This inset distance allows the first pitching blade cuts to be made by splitting blades 504, 506 and 508, and then allows the press to apply pressure to splitting blades 510, 512, 514, 516, 518 and 520 for the second cuts. Likewise, perpendicular splitting blades 510 through 520 can be omitted such as to perform single splits of blocks 522, 524, and 526.

Figure 6:
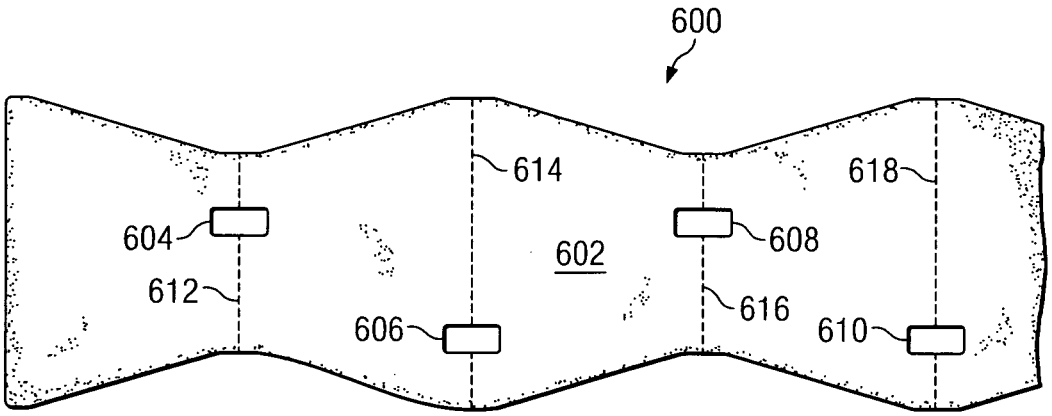
FIG. 6 is a diagram of a masonry block in accordance with an exemplary embodiment of the present invention.

FIG. 6 is a diagram of masonry block 600 in accordance with an exemplary embodiment of the present invention. Masonry block 600 includes alternating wide and narrow sections with holes 604 through 610. Holes 604 through 610 are located along split lines 612 through 618 so as to form a false joint upon splitting. Likewise, the mold for forming block 602 can include blackouts or other suitable devices as the locations indicated by holes 604 through 610, so as to add ornamental features to the split surface, such as a false joint or other suitable features. By staggering the location of the holes 604, 606, 608, 610, a variety of configurations of blocks having false joints can be readily formed by the splitting operation, so as to allow a large variety of masonry blocks having false joints or other features to be easily manufactured without tooling changes. Such variation is desirable to allow a wall having a highly variable surface appearance to be fabricated, and eliminates the need to manually machine false joints or other features in the masonry blocks.

Figure 7:
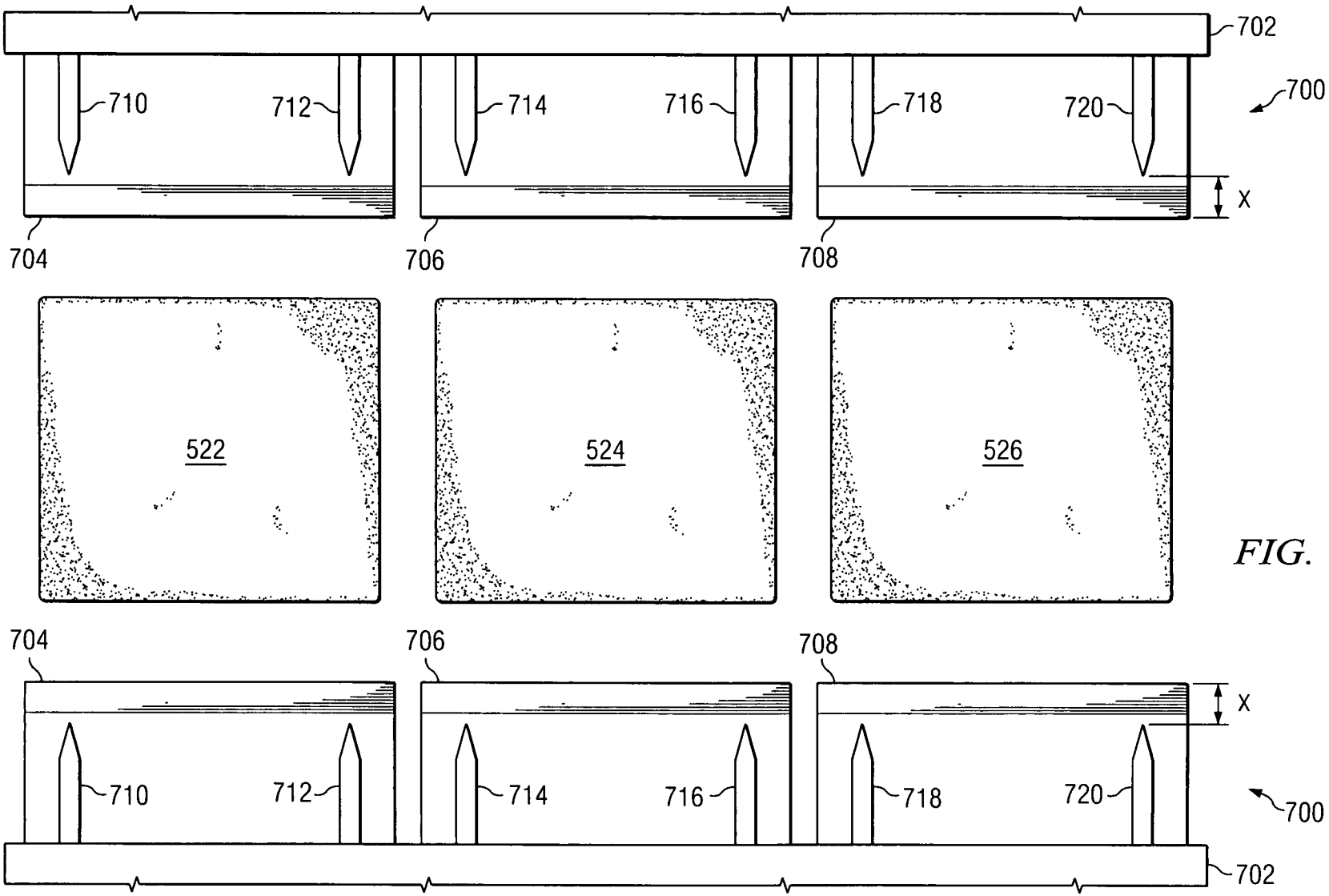
FIG. 7 is a diagram of a splitting blade assembly in accordance with an exemplary embodiment of the present invention.

FIG. 7 is a diagram of splitting blade assembly 700 in accordance with an exemplary embodiment of the present invention. Splitting blade assembly 700 includes blade holder 502 with splitting blades 504, 506, and 508, and blade holder 702 with splitting blades 704, 706, and 708. The sets of three splitting blades (504, 506, 508 and 704, 706, 708) are independent of and separated from each other, and can be used in conjunction with a compressible material 106 so as to allow each blade to conform to irregularities on the top and bottom surfaces of the masonry block being split. Three separate blocks 522, 524, and 526, can be split by splitting blade assembly 700.

Splitting blades 510 and 512 are associated with splitting blade 504 and form a splitting blade assembly similar to that shown in FIG. 2. Likewise, the blade edge of splitting blades 510 through 520 and 710 through 720 are inset from the blade edge of the associated perpendicular splitting blades 504 through 508 and 704 through 708, respectively, by a distance "X." This inset distance allows the first pitching blade cuts to be made by splitting blades 504 through 508 and 704 through 708, and then allows the press to apply pressure to splitting blades 510 through 520 and 710 through 720 for the second cuts. Likewise, perpendicular splitting blades 510 through 520 and 710 through 720 can be omitted such as to perform single splits of blocks 522, 524, and 526.

Figure 8:
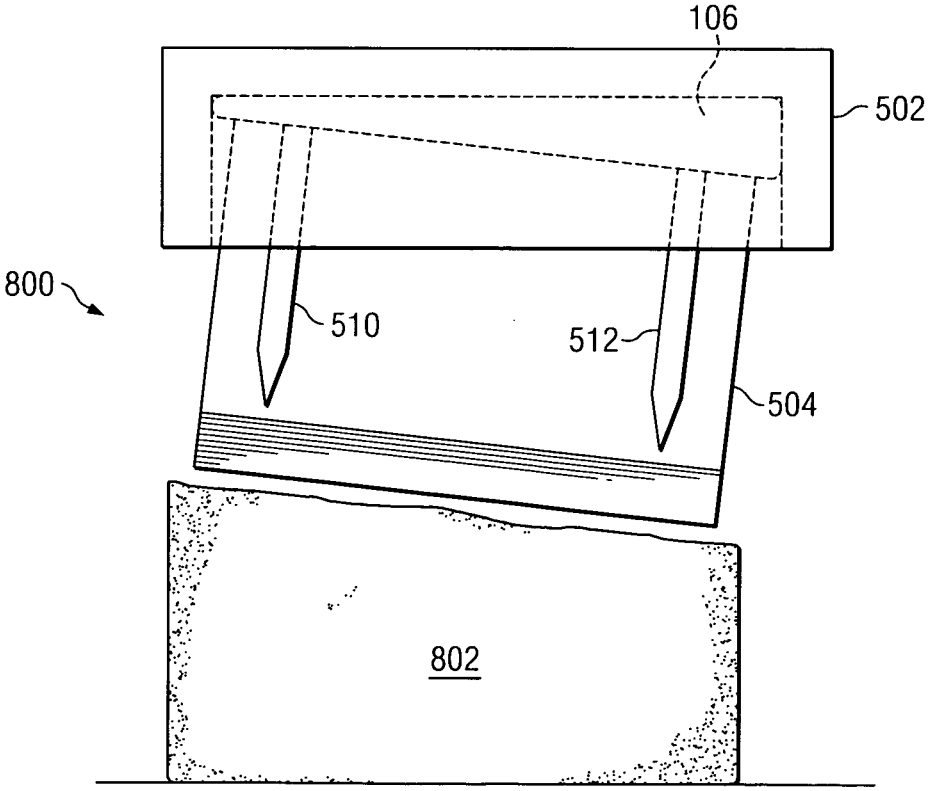
FIG. 8 is a diagram of a manufacturing step in accordance with an exemplary embodiment of the present invention.

FIG. 8 is a diagram of manufacturing step 800 in accordance with an exemplary embodiment of the present invention. Manufacturing step 800 shows masonry block 802 having a surface that is not horizontal. Compressible material 106 allows blade holder 104 and splitting blade 102 to conform to the surface of masonry block 802. Without compressible material 106, the uneven surface of masonry block 802 could cause splitting blade 102 to initiate a split along a short section of masonry block 802, which can result in split propagation outside of the plane of splitting blade 102. Compressible material 106 allows splitting blade 102 to contact more points along the surface of masonry block 802, thus ensuring that split propagation will occur along the plane of splitting blade 102.

Figure 9:
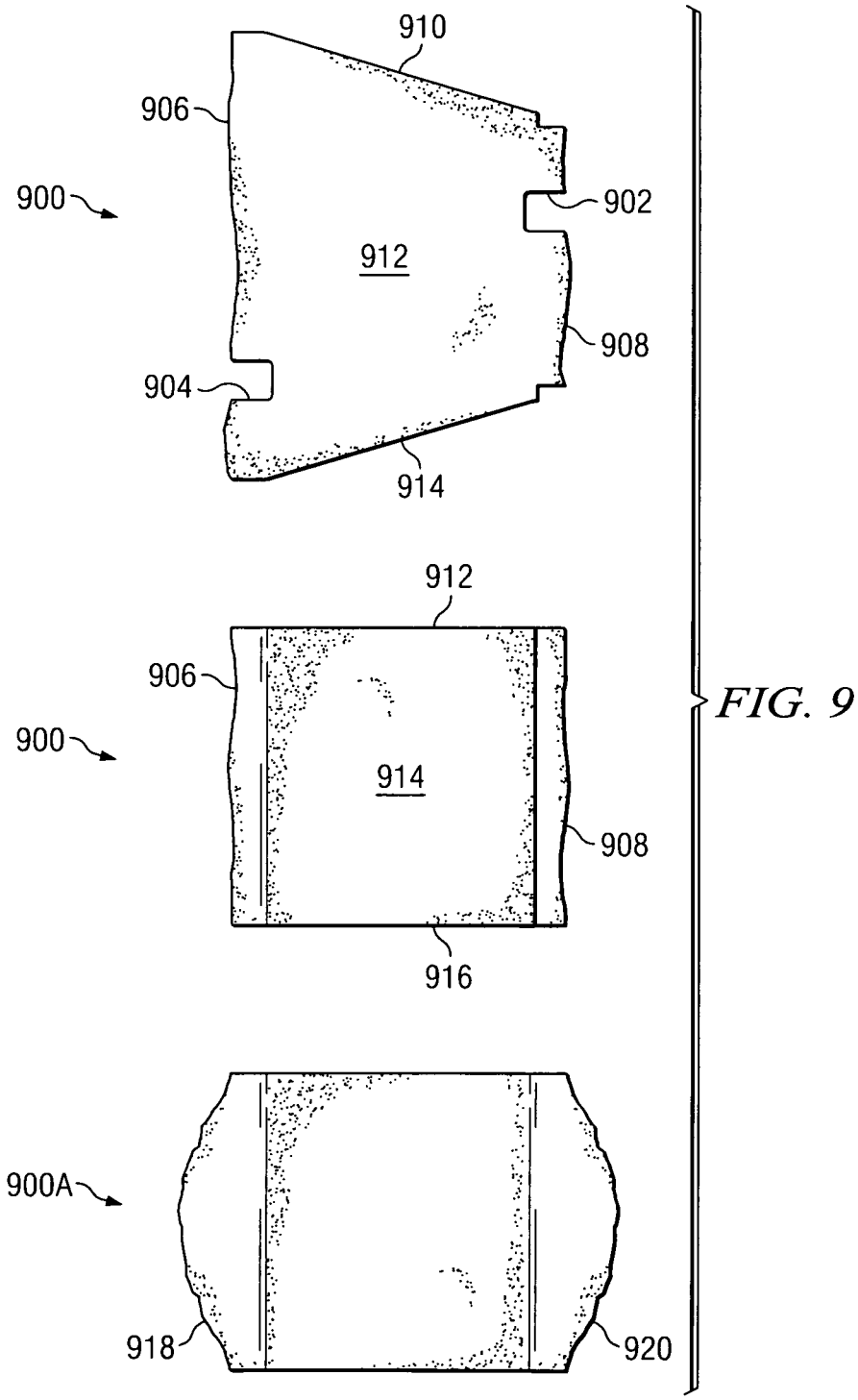
FIG. 9 shows various views of a masonry block fabricated in accordance with an exemplary embodiment of the present invention.

FIG. 9 shows various views of a masonry block 900 fabricated in accordance with an exemplary embodiment of the present invention. Masonry block 900 includes false joints 902 and 904, which are formed using mold block-outs to create holes in a masonry block at split lines. Split surfaces 906 and 908 are formed by splitting blades, and smooth surfaces 910 through 916 are molded surfaces. Likewise, pitched surfaces 918 and 920 of masonry block 900A can also be provided, such as by pitching split surfaces 906 and 908 during or after the splitting process.

Although exemplary embodiments of a system and method of the present invention have been described in detail herein, those skilled in the art will also recognize that various substitutions and modifications can be made to the systems and methods without departing from the scope and spirit of the appended claims.

What is claimed is:

1. An apparatus for splitting a plurality of masonry blocks comprising:

a plurality of adjacent first splitting blades, each coplanar with a centerline of a blade support and with adjacent blades, and each spaced with adjacent blades along the centerline, configured to simultaneously move in a first direction so as to split a corresponding one of the plurality of masonry blocks into two or more sections, each section having a first split surface, during a single splitting operation; and a plurality of second splitting blades, each perpendicular and adjacent to a corresponding one of the first splitting blades, each of the second splitting blades is configured to form a second split surface on one of the masonry block sections that is perpendicular to at least one of the first split surfaces.

2. The apparatus of claim 1 further comprising one or more third splitting blades, each perpendicular and adjacent to one of the first splitting blades and configured to form a third split surface on one of the masonry block sections that is perpendicular to at least one of the first split surfaces.

3. The apparatus of claim 1 wherein a cutting edge of one or more of the first splitting blades is offset from a cutting edge of the corresponding second splitting blade.

4. The apparatus of claim 1 further comprising one or more third splitting blades, each perpendicular and adjacent to one of the first splitting blades, wherein a cutting edge of each of the third splitting blades is offset from a cutting edge of the corresponding first splitting blade.

5. The apparatus of claim 1 wherein one or more of the masonry blocks includes one or more holes located at a split line so as to form a false joint after splitting.

6. The apparatus of claim 1 wherein one or more of the first splitting blades comprises two opposing planar surfaces and one or more of the second splitting blades extends perpendicularly from either planar surface of the corresponding first splitting blade.

7. The apparatus of claim 1 wherein one or more of the second splitting blades extend perpendicularly from a single planar surface of the corresponding first splitting blade.

8. The apparatus of claim 1 further comprising a plurality of blade supports, each holding one of the first splitting blades and one of the second splitting blades.

9. The apparatus of claim 8 further comprising a compressible material disposed between one or more of the blade supports and a press.

10. An apparatus for forming a plurality of masonry blocks comprising:

a plurality of adjacent first splitting blades, each coplanar with a centerline of a blade support and with adjacent blades and each spaced with adjacent blades along the centerline, configured to simultaneously move in a first direction so as to split each of a plurality of masonry blocks into two or more sections, each section having a first split surface, during a single splitting operation; and a second splitting blade perpendicular and adjacent to one of the first splitting blades, the second splitting blade is configured to form a second split surface at a first end of one of the masonry block sections that is perpendicular to the first split surface of the masonry block section; and a third splitting blade perpendicular and adjacent to one of the first splitting blades, the third splitting blade is configured to form a third split surface at a second end of the masonry block section that is perpendicular to the first split surface of the masonry block section and parallel to the second split surface.

11. The apparatus of claim 10 wherein a cutting edge of the first splitting blade is offset from a cutting edge of the corresponding second splitting blade.

12. The apparatus of claim 10 wherein a cutting edge of the first splitting blades is offset from a cutting edge of the corresponding third splitting blade.

13. The apparatus of claim 10 wherein one or more of the masonry blocks includes one or more holes located at a split line so as to form a false joint after splitting.

14. The apparatus of claim 10 wherein one or more of the first splitting blades comprises two opposing planar surfaces and the second splitting blade extends perpendicularly from one of the planar surfaces of the corresponding first splitting blade.

15. The apparatus of claim 10 wherein the second splitting blade extends perpendicularly from a planar surface of the corresponding first splitting blade.

16. The apparatus of claim 10 further comprising a blade support holding one of the first splitting blades and the corresponding second splitting blade.

17. The apparatus of claim 16 further comprising a compressible material disposed between one or more of the blade supports and a press.

* * * * *